US006969409B2

(12) United States Patent
Ichimura et al.

(10) Patent No.: US 6,969,409 B2
(45) Date of Patent: Nov. 29, 2005

(54) ANIMAL FIBER SUPERIOR IN SHRINK PROOFING AND METHOD FOR PREPARATION THEREOF

(75) Inventors: Hisashi Ichimura, Haguri-gun (JP); Ryo Umehara, Hashima-gun (JP); Tadashi Karakawa, Haguri-gun (JP); Kunihiro Oshima, Osaka (JP); Kazuhiro Nakase, Katano (JP)

(73) Assignee: Kurabo Industries Ltd., Okayama-ken (JP)

( * ) Notice: Subject to any disclaimer, the term of this patent is extended or adjusted under 35 U.S.C. 154(b) by 0 days.

(21) Appl. No.: 09/902,256

(22) Filed: Jul. 11, 2001

(65) Prior Publication Data

US 2002/0032930 A1 Mar. 21, 2002

Related U.S. Application Data

(63) Continuation-in-part of application No. 09/721,772, filed on Nov. 27, 2000.

(30) Foreign Application Priority Data

Jul. 26, 2000 (JP) ..... 2000-225174
Mar. 1, 2001 (JP) ..... 2001-057004

(51) Int. Cl.[7] ..... D06M 11/00; D06M 16/00

(52) U.S. Cl. ..... 8/128.1; 8/115.54; 8/149.2; 435/263

(58) Field of Search ..... 8/128, 149.2, 115.54, 8/94.1 R, 112, 114.6, 115.51, 115.7, 128.3; 435/263

(56) References Cited

U.S. PATENT DOCUMENTS 3,457,213 A * 7/1969 Manos ..... 524/372
4,189,303 A * 2/1980 Thorsen ..... 8/115.7
4,214,330 A * 7/1980 Thorsen ..... 8/149.2
4,300,367 A * 11/1981 Thorsen ..... 68/5 D
4,533,359 A * 8/1985 Kondo et al. ..... 8/128.1
5,529,928 A * 6/1996 Ciampi et al. ..... 435/263
5,928,383 A * 7/1999 Russell et al. ..... 8/128.3

FOREIGN PATENT DOCUMENTS

| | | |
|---|---|---|
| JP | 3-19961 | 1/1991 |
| JP | 10-72762 | 3/1998 |
| JP | 2001-3238 | 1/2001 |
| JP | 2001-164460 | 6/2001 |

OTHER PUBLICATIONS

Hojo, H. et al.,Proc. 9$^{th}$ Inter. Wool Text. Res. Conf., Biella, (1)217, (1995).
Hojo H. et al., Proc. 8$^{th}$ Inter. Wool Text. Res. Conf. Christchurch, (IV)390, (1990).
Patent Abstracts of Japan, vol. 1996, No. 07, Jul. 31, 1996 (Abstract of JP 08 074178A).

* cited by examiner

*Primary Examiner*—Yogendra N. Gupta
*Assistant Examiner*—Preeti Kumar
(74) *Attorney, Agent, or Firm*—Wenderoth, Lind & Ponack, L.L.P.

(57) ABSTRACT

The present invention provides an animal fibers having improved shrink proofing and pilling resistance properties and method for preparation thereof.

An animal fiber having excellent shrink proofing and pilling resistance and retaining its original water repellency is also provided. A method of treating animal fiber in which a surface layer part of animal fiber is primary-oxidized in advance with an oxidizer, and aqueous treatment liquid containing ozone in the form of ultrafine bubbles of 5$\mu$ or less is allowed to collide against the fiber by blowing the liquid on the fiber in the aqueous treatment solution, and then, the fiber is treated with a reducing agent. Particularly, the above-mentioned method for treating animal fiber in which ultrafine bubbles of ozone are formed by using a line mixer. The method in which an apparatus which collects the ultrafine ozone bubbles in aqueous treatment liquid on the fiber is used so that the bubbles are not scattered out of a treatment reaction bowl.

8 Claims, 5 Drawing Sheets

Fig. 4

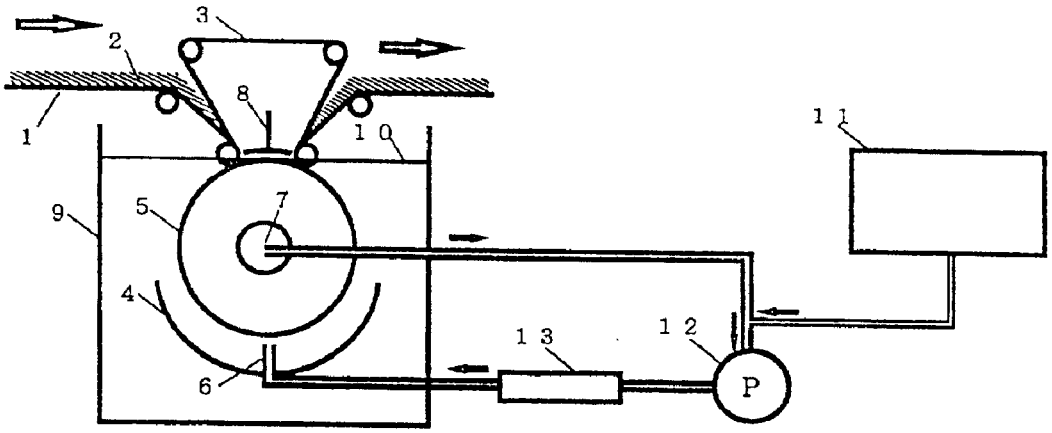

Fig. 5

| | untreated wool fiber | Chlorine treated · Resin treated | Ozon treatment |
|---|---|---|---|
| just after dropping of water droplet | knitted cloth, water droplet<br>water droplet is remained | water droplet is remained | water droplet is remained |
| 2 minutes after dropping of water droplet | water droplet is remained | water mostly permeated | water droplet is remained |
| 30 minutes after dropping of water droplet | water droplet is remained | water perfectly permeated | water droplet is remained |

ANIMAL FIBER SUPERIOR IN SHRINK PROOFING AND METHOD FOR PREPARATION THEREOF

This is a continuation-in-Part application of Ser. No. 09/721,772, filed Nov. 27, 2000.

BACKGROUND OF THE INVENTION

1. Field of the Invention

The present invention relates to an animal fiber to which shrink proofing and pilling resistance are given, and a method for preparation thereof. More specifically, the present invention relates to an animal fiber to which shrink proofing and pilling resistance are given without impairing a superior water repellent property that animal fibers originally possess and a method for preparation thereof.

2. Description of the Prior Art

Animal fiber is peculiar natural fiber having specific hand-feeling texture depending on sheep breeds, revealing bio-degradability, having various excellent properties such as hygroscopicity, moisture-releasing property, heat retaining property, flame retardancy and dyeing property, and further, water-repellency. It is special fiber which has appropriate fiber strength and elongation permissible for wear and higher abrasion resistance, also from the standpoint of fiber mechanical properties, and has been esteemed for long time. However, felting property in aqueous washing and pilling property in wear derived from a cuticle tissue structure of animal fiber are undesirable natures as apparel wear. Therefore, studies for improving the surface have been long effected mainly on shrink proofing, and pilling resistant work has also been conducted along with the studies. However, any of animal fiber obtained like this is an improving method sacrificing the water repellency which is an inherent nature of animal fiber. A water repellent membrane of animal fiber is an organization for exerting an influence on hygroscopicity and moisture releasing property and for controlling heat transfer accompanied by adsorption and desorption of water, and exerts an influence on heat retaining property and comfortability. In other words, the conventional shrink proofing product can prevent shrink by aqueous washing, but lacks in heat retaining property and comfortability.

As a conventional typical shrink proofing work, there is a shrink proofing method using a chlorine agent, and specifically, what is called chlorine-Hercosett shrink proofing method in which a cuticle tissue of animal fiber is hydrophilizated, the tissue is made soft or removed to impart shrink proofing property, and further, the cuticle tissue is coated with a polyamide epichlorohydrin resin (Hercosett resin, manufactured by Dick Herculess) for enhancing the resistance to aqueous washing. Currently, this method is spread around the world, and recognized provisionally as a complete method as a shrink proofing method of wool.

However, from the stand point of environmental conservation spread currently around the world, a shrink proofing work using a chlorine agent and chlorine-containing resin has caused a problem of the discharging amount of an Adsorbable Organic Halides (AOX), and a novel shrink proofing method of animal fiber using no chlorine agent is being studied presently. However, a satisfactory method replacing the chlorine-Hercosett shrink proofing method has not been developed yet.

Japanese Patent Kokai No. 126997/1975 discloses a method in which dyeing property and shrink proofing of wool and pilling resistance of a wool-synthetic fiber blended product are improved without deteriorating hand-feeling and fiber strength of wool according to a procedure in which wool sliver is impregnated with an aqueous solution of acids or acidic salts and drained by squeezing rolls, and is placed in a sealed chamber previously filled with an ozone-containing gas having an ozone concentration of 35.5 mL/L, and further, treated at 50° C. for 10 minutes while feeding a new ozone-containing gas. However, this method carries out only oxidation into a cystine crosslinked bond (—S—S—) which performs main role of wool shrink proofing, and no reduction treatment is conducted. In the case of wool, a —S—S-bond is not cleaved until this reduction treatment and this cleavage gives satisfactory shrink proofing to wool, therefore, sufficient shrink proofing and pilling resistance can not be obtained by the disclosed method. Further, the above-mentioned methods is conducted in a sealed system since the treatment should be conducted in an ozone gas atmosphere, and exposure is effected with the aid of molecular movement of an ozone gas, therefore, when the amount of wool treating is increased, unevenness of an ozone gas exposure can not be avoided, and this directly produces a unevenness treatment and uniform wool shrink proofing and dyeing are not obtained. At the same time, in the above-mentioned method, the productivity is low due to the sealed system treatment, and when an ozone gas leaks directly out of the treating apparatus, deterioration in working environment and environmental charge are large, and industrialization is difficult.

Japanese Patent Kokai No. 142759/1980 discloses a method and an apparatus in which fiber is treated with an ozone-steam mixed material. In this method, worsted knitted fabric made of keratinous animal fiber is suspended on a belt conveyor circulating in a special treatment apparatus equipped with an exhaust apparatus, steam is introduced in this apparatus to increase the temperature to 79° C., a fan is started to introduce an ozone-air mixed gas (ozone introduction amount: 3.4 g/minute) and this mixed gas retained in the apparatus for 8.25 minutes to impart shrink proofing. Also in this method, only ozone oxidation is conducted, and no reduction treatment is effected. Therefore, the imparted shrink proofing is not satisfactory, and further, an ozone gas tends to leak due to the defective construction of apparatus, inviting deterioration in working environment.

Japanese Patent Kokai No. 19961/1991 discloses a method of shrink proofing of animal fiber using ozone as an oxidizer. It describes that an ozone gas is passed through a glass filter to give fine bubbles, in a water bath, and this bubbles are allowed to contact animal fiber. But bubbles generated through a glass filter or the like are too large to render ozone gas bubbles to reach fine portions in a fiber assembly, and treat only the surface of the fiber assembly. It is well known from experience that when a wool product containing about 90% of shrink-proofed wool fiber and about 10% of un-shrink-proofed wool fiber in mixture is washed in water, it is shrunk in the same extent as a un-shrink-proofed wool product, whereas, in the above-mentioned method, an unevenness exposure on wool by an ozone gas makes a unevenness treatment, and sufficient shrink proofing is not obtained due to this unevenness.

Japanese Patent Kokai No. 72762/1998 discloses a method in which fiber is immersed in the form of tow, thread, fabric, knit fabric and the like into a water-dissolved ozone prepared by dispersing in water an ozone-containing gas composed of ozone and oxygen or air in the form of bubbles having a diameter of 0.08 mm or less. It describes a method in which an ozone-containing gas is introduced in water to form bubbles, this bubbles are broken by allowing it to collide against small walls in a line mixer when it passes through the line mixer, to give fine bubbles having a diameter of 0.08 mm or less showing enhanced solubility in water, for obtaining ozone dissolved in water having high concentration. This is merely a method for treating rayon and other fiber using ozone in dissolved in water.

SUMMARY OF THE INVENTION

The present invention provides an animal fiber to which high shrink proofing and pilling resistance are simultaneously given without impairing its water repellence. Moreover, the present invention also provides a method for preparation of the animal fiber in which a chemical not containing toxic chlorine is used from the view point of environmental preservation.

The present invention relates to an animal fiber which is superior in shrink proofing and pilling resistance, and maintains a water repellent property that animal fibers originally possess.

Specifically, the present invention relates to the animal fiber wherein the shrink proofing is set to an area shrinkage rate of not more than 8% in a three-hours aqueous washing, when measured as a felting shrinkage rate in conformity with a WM TM 31 method (Wool Mark Test Method 31).

More specifically, the present invention relates to the animal fiber which, with respect to a value represented by a difference ($\mu_a$–$\mu_w$) between the coefficient of friction in the tip to root direction ($\mu_a$) and the coefficient of friction in the root to tip direction ($\mu_w$) with respect to a fiber direction, measured in accordance with JIS L-1015 method, has a reduction of not less than 30% in comparison with the difference ($\mu_a$–$\mu_w$) of untreated animal fiber in coefficient of static friction or in coefficient of dynamic friction, with the value of $\mu_a$ being approximately the same as a value in the case of the untreated animal fiber and the value of $\mu_w$ having an increase of not less than 30% in comparison with a value in the case of the untreated animal fiber.

The present invention also relates to the animal fiber in which the pilling resistance is not lower than third class in JIS L-1076.6.1A method.

More specifically, the present invention relates to the animal fiber wherein, supposing that an absorbance of an absorption band corresponding to amide I is set to 1 in a reflection FT-IR measuring method, the degree of oxidation of a —S—S— bond (cystine bond) in a epidermal cell of the animal fiber is represented by a relative absorbance of not less than 0.1 in an absorption band of $-SO_3H$ group (sulfonic acid group) and/or a relative absorbance of not less than 0.08 in an absorption band of —S—$SO_3Na$ group (Bunte salts).

Further, the present invention relates to a method for preparation of animal fiber comprising;

a) a first step in which a —S—S— bond (cystine bond) in the cuticle cell of an animal fiber is treated by primary oxidation into lower order oxidized state, b) a second step in which the primary-oxidized —S—S— bond is treated by oxidation into any one or more higher order oxidized states of di, tri or tetra-oxidized state, and c) a third step in which said —S—S— bond in di, tri or tetra-oxidized state is treated by reduction fission.

More further, the present invention relates to a method for preparation of animal fiber comprising;

a) a first step in which a —S—S— bond in the cuticle cell of an animal fiber is treated by primary oxidation with an oxidizer having an ability to oxidize a cystine —S—S-bond in animal fiber, b) a second step in which the primary-oxidized —S—S— bond is treated by oxidation with ozone into any one or more higher order oxidized states of di, tri or tetra-oxidized state, and c) a third step in which said —S—S— bond in higher oxidized state is treated by reduction fission.

And additionally, the present invention relates to animal fiber superior in shrink proofing and pilling resistance properties obtained by any one of the methods described above.

Additionally, in the above description "supposing that an absorbance of an absorption band corresponding to amide I is set to 1 in a reflection FT-IR measuring method, the degree of oxidation of a —S—S— bond (cystine bond) is represented by a relative absorbance of not less than 0.1 in an absorption band of —$SO_3H$ group (sulfonic acid group) and/or a relative absorbance of not less than 0.08 in an absorption band of —S—$SO_3Na$ group (Bunte salts)", "the relative absorbance in an absorption band of —$SO_3H$ group (sulfonic acid group)" more specifically refers to a relative absorbance of the absorption band of 1040 $cm^{-1}$ corresponding to the —$SO_3H$ group (sulfonic acid group) measured by the reflection FT-IR measuring method (ATR method) in the case when the absorption band of 1650 $cm^{-1}$ corresponding to amide I is set to 1. Moreover, "the relative absorbance in an absorption band of —S—$SO_3Na$ group (Bunte salts)" refers to a relative absorbance of the absorption band of 1024 $cm^{-1}$ corresponding to the —S—$SO_3Na$ group (Bunte salts) measured by the reflection FT-IR measuring method (ATR method) in the case when the absorption band of 1650 $cm^{-1}$ corresponding to amide I is set to 1.

(a) Untreated wool fiber, (b) Chlorine-treated wool fiber, (c) Chlorine-Hercosett-treated wool fiber (d) Wool fiber of the present invention.

Figure 3:
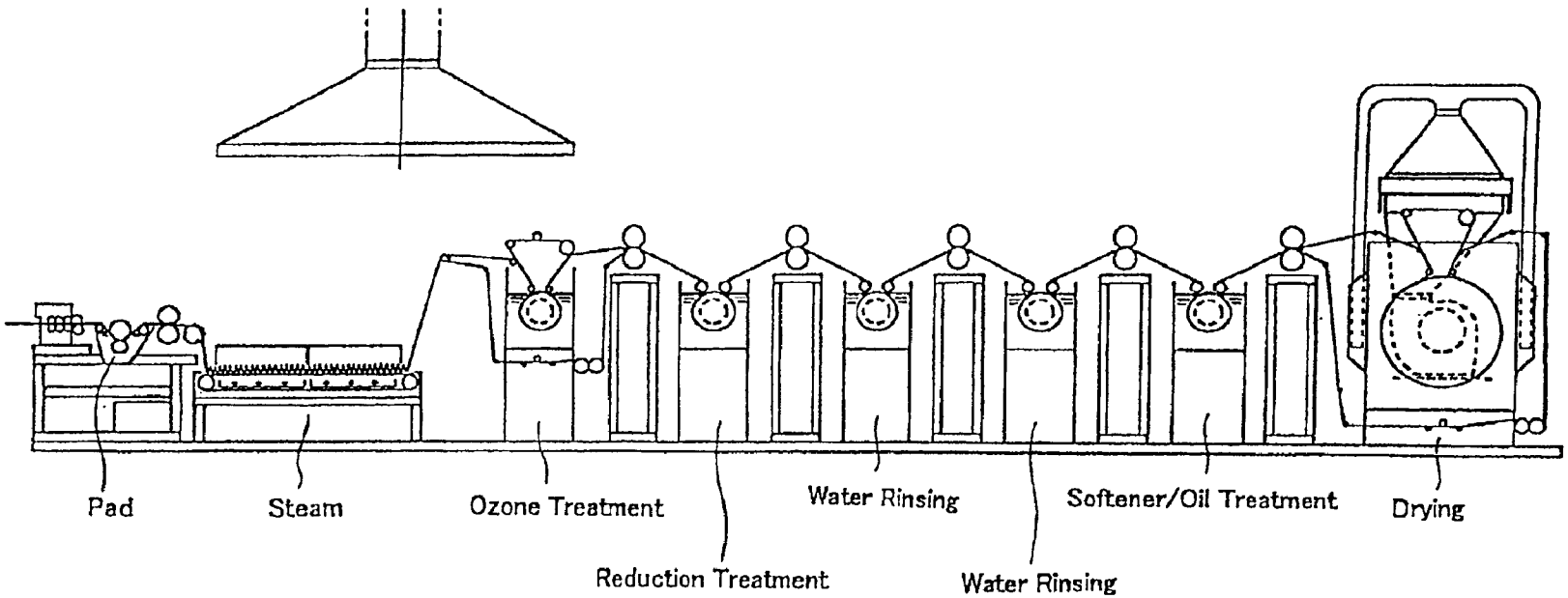

FIG. 3 is a side view that shows a processing device used for the method of the present invention.

FIG. 4 is a drawing that explains an ozone treatment method.

FIG. 5 is a drawing that shows a state in which various wool fibers of Example 3 are observed with respect to water repellency in a macroscopic manner.

Figure 6:
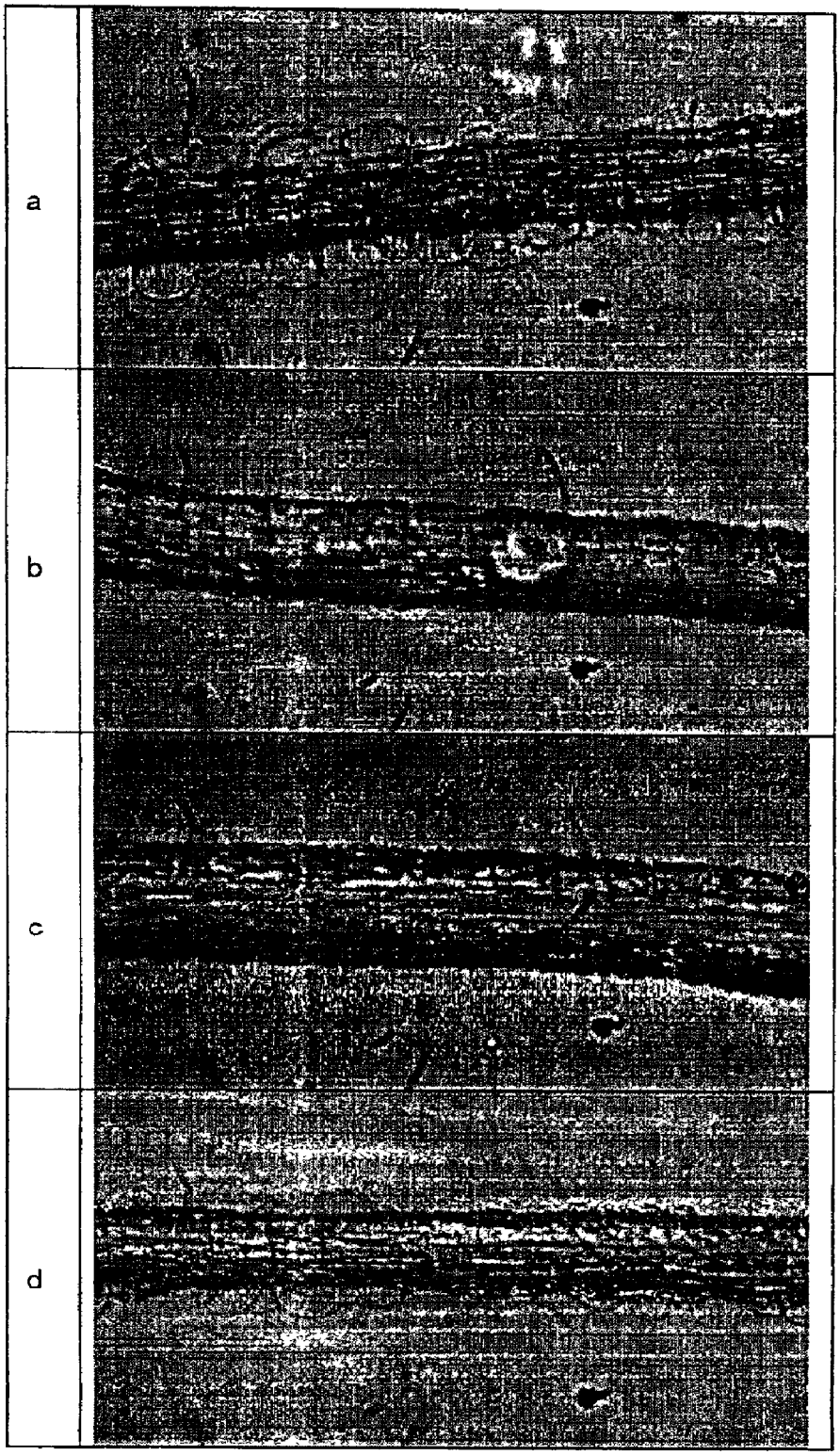

FIG. 6 are optical microscopic photographs that show states of untreated wool fiber and various shrink-proofing treated wool fiber under Allwörden reaction.

(a) Untreated wool fiber, (b) Chlorine-treated wool fiber (c) Chlorine-Hercosett-treated wool fiber (d) Wool fiber of the present invention.

DETAILED DESCRIPTION OF THE INVENTION

The animal fiber of the present invention is characterized in that it has superior shrink proofing and pilling resistance while maintaining a water repellent property that animal fibers originally possess.

The shrink proofing of the animal fiber of the present invention is represented by using the felting shrinkage rate or the difference in coefficient of friction in single fiber as a measure.

When represented by the felting shrinkage rate, the shrink-proofing of the animal fiber of the present invention is not more than 8% in the area shrinkage rate in a three-hours aqueous washing. More preferably, it is not more than 5%.

In the case when represented by the coefficient of friction in single fiber, with respect to a value represented by a difference ($\mu_a$–$\mu_w$) between the coefficient of friction in the tip to root direction ($\mu_a$) and the coefficient of friction in the root to tip direction ($\mu_w$) with respect to a fiber direction, it has a reduction of not less than 30% in comparison with that of untreated animal fiber in a static coefficient of friction or in a dynamic coefficient of friction. More preferably, it has a reduction of not less than 40%. Moreover, the value of $\mu_a$ is approximately the same as a value in the case of the untreated animal fiber and the value of $\mu_w$ has an increase of not less than 30% in comparison with a value in the case of the untreated animal fiber.

Here, in the present invention, the felting shrinkage rate is measured in conformity with WM TM31 method (Wool Mark Test Method 31), and a fabric knitted into a cover-factor C.F. 0.41 with one thread being taken from 14 gages is used as a sample. Here, "conformity to "WM TM31 method" refers to the fact that the measurements were carried out in accordance with the testing procedure of WM TM31 method set based upon the ISO 6330 method, while the test washing machine was changed to a Cubex shrinkage testing machine.

In the present invention, the coefficient of friction of the single fiber is measured in accordance with JIS L 1015, and the following conditions are used:

Test machine: Radar type test machine for coefficient of friction

Hanging line load: 200 mg

Cylinder peripheral velocity: 90 cm/min.

In this case, $\mu_a$ is a coefficient of friction in the tip to root direction with respect to a fiber direction, and $\mu_w$ is a coefficient of friction in the root to tip direction with respect to a fiber direction.

The pilling resistance of the animal fiber of the present invention is quantitatively represented by a pilling test method in accordance with JIS L 1076.6. 1A, and it is not lower than the third class in pilling resistance.

Based upon the above reference, the pilling test is carried out under the following conditions:

Test machine: ICI-type pill box test machine

Knitted fabric: A fabric knitted by IP18G is used.

Water repellency is evaluated by putting a water droplet on a knitted fabric made of animal fibers to be tested and observing the permeability of the water droplet into the knitted fabric. The criteria of the evaluation are:

○: A water droplet stays on the fabric after a lapse of 30 minutes (equivalent to natural animal fibers, etc.).

Δ: Virtually the whole of a water droplet permeates into the fabric after a lapse of 2 to 30 minutes.

×: Virtually the whole of a water droplet permeates into the fabric in less than 2 minutes.

Here, the evaluation of water repellency may be made by putting a sample in the form of sliver on the surface of water and measuring the time at which the sliver absorbs water and sinks into water. In the animal fiber in accordance with the present invention, a water droplet stays after a lapse of 30 minutes in the same manner as natural animal fibers.

Moreover, the existence of a surface layer of epicuticle which adds a water repellent property to the animal fiber may be confirmed by an Allwörden reaction (Wool Science Review, Vol. 63 (1986)) in which animal fiber is dipped in a saturated chlorine water solution or a saturated bromine water solution to find generation of bubbles on the surface thereof.

The superior properties of the animal fiber of the present invention is achieved by changing conformation of scale structure, and by exemplifying the surface structure of wool, the mechanism of exertion of such superior shrink proofing and pilling resistance that the inventors, etc., of the present invention have found is explained below.

Figure 1:
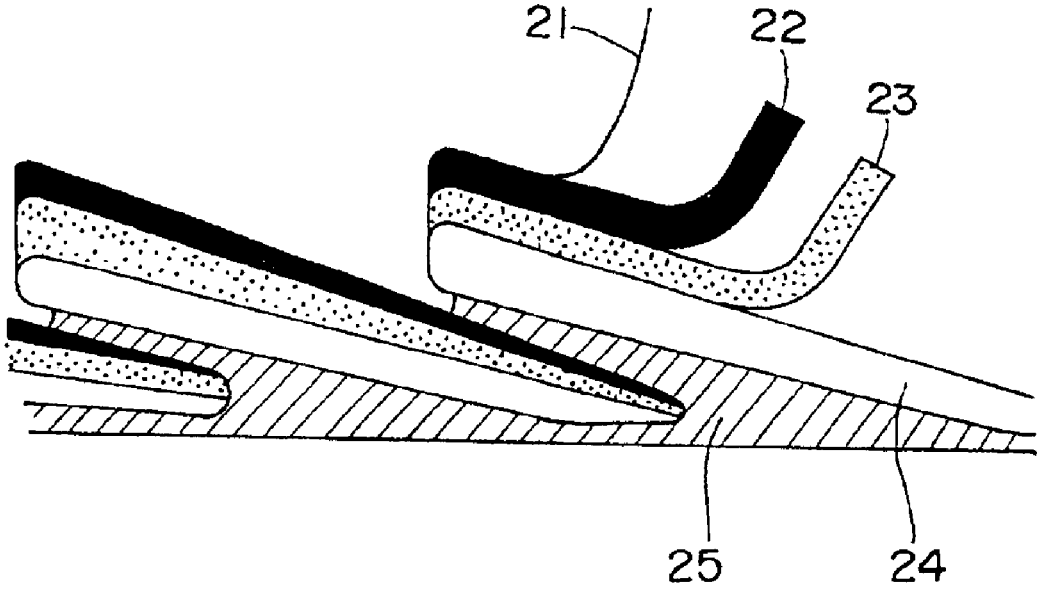
FIG. 1 is a schematic longitudinal cross-sectional view that shows an animal fiber.

FIG. 1 (quoted from Wool Science Review Vol. 63 (1986)) is a schematic longitudinal cross-sectional view that shows the surface portion of a wool fiber. An epidermal tissue (cuticle) portion, called scales, consists of an epicuticle layer (21), an exocuticle A-layer (22), an exocuticle B-layer (23) and an endocuticle layer (24) as an innermost layer that are stacked in this order from outside. Moreover, the outer surface of the epicuticle layer is combined with a layer having a thickness of approximately 0.9 nm that is made from a higher fatty acid (mainly made of eicosanoic acid) which is bonded to a —SH residue of a polypeptide chain in the epicuticle layer through a thioester bond, and the alkyl group of this eicosanoic acid allows the animal fiber to exert a superior water repellence property.

Further particularly, higher fatty acids possessing water repellency which constitutes the outermost surface of the fiber, particularly, eicosanoic acid is connected with an epicuticle layer (cystine content: 12%) via a thioester bond, and further, the epicuticle layer and an exocuticle A layer (cystine content: 35%) adjacent to the lower side of the epicuticle layer form an integrated structure, occupying about 20% of the total thickness of the cuticle, and cystine bonds are distributed in this tissue concentrically in an amount of about 70% based on the whole cystine content of the cuticle. The remaining about 30% is known to be composed of an exocuticle B layer (cystine content: 15%) and an endocuticle (cystine content: 3%).

Most of cuticle tissue is composed of an exocuticle A and B layers and endocuticle layer, and the exocuticle A layer form an integrated tissue structure with epicuticle layer, and the felting phenomenon depends, substantially, on the exocuticle B layer and endocuticle layer.

When animal fiber is immersed in water, each layer absorbs water more or less and swells. But, naturally, the more cystine crosslinkage develops, the less the extent of swelling with water is. And therefore, when animal fiber is immersed in water, endocuticle layer having lower cystine crosslinked density which is the innermost layer, is swollen with water and extends, but on the contrary, the outer layer, exocuticle layer, having higher cystine crosslinked density has less extent of water swelling and therefore the extent of the expansion in the exocuticle layer is smaller. Such difference of the expansion by difference of swelling produces the edge of uprising of the scale and resulting the entanglement of fiber with fiber, causing felting.

More specifically, fibers are entangled with each other, and onto the entangled portions, other fibers are entangled by an external force applied to the fabric at the time of aqueous washing so that the entire fibers are drawn in the entangled portions, causing shrinkage in the length of the entire fiber lump to form felt; thus, felting results in further shrinkage.

The animal fiber of the present invention which is superior in shrink proofing and pilling resistance is mainly realized by a chemical modification of the epidermal tissue, and the swelling properties of the exocuticle B-layer and the endocuticle layer are made virtually equal to each other with the water repellence property of the eicosanoic acid on the uppermost surface being maintained so that, even when dipped into water, the rising of the scales is virtually eliminated.

In other words, while the integral structural body of the epicuticle layer and the exocuticle A-layer that is a hard structure in terms of the organized structure is maintained, that is, while eicosanoic acid exerting repellency is maintained, only the exocuticle B-layer is selectively attacked so that its cystine bond, that is, its cross-linking structure, is broken. Only the portions of the surface of the fiber, especially those related to swelling and shrinkage, are subjected to the modification, with the inside of the fiber being protected; therefore, the resulting feature is that the water repellence property of the entire fiber is maintained and the fiber strength is also maintained.

The above-mentioned structural change by the treatment of the present invention is confirmed by a reflection FT-IR measuring method (ATR method). The structure within 1 $\mu$m from the surface is reflected by the reflection FT-IR measurements, and this is equivalent to the thickness of the epidermal tissue of the animal fiber that is approximately 1 $\mu$m. With respect to the FT-IR absorbance of the animal fiber that has been subjected to the modifying treatment, both of relative absorbances in the absorption band of 1040 $cm^{-1}$ corresponding to the —$SO_3H$ group (sulfonic acid group) and the absorption band of 1024 $cm^{-1}$ corresponding to the —S—$SO_3Na$ group (Bunte salts), obtained in the case when the absorption band corresponding to amide I (1650 $cm^{-1}$) is set to 1, have an increase in comparison with the relative absorbance of untreated animal fibers, thereby indicating that the cross-linking bond of the exocuticle B-layer has been cut.

In contrast, in the case of the animal fiber obtained through a chlorine treatment method or a Chlorine-Hercosett method, etc. that is a typical conventional method, the integral structural body of the epicuticle layer and the exocuticle A-layer is directly attacked, and in particular, the epicuticle layer is severely damaged, with the result that the water repellence layer is broken to lose its water repellence property that the animal fiber originally features. In addition, since the oxidation action is exerted to the entire fiber, resulting in degradation in the strength.

Moreover, the conventional shrink proofing animal fiber has a smoother scale surface so that in comparison with the animal fiber of the present invention which maintains the scales, there is a reduction in the single-fiber drawing abrasion resistance, failing to provide sufficient pilling resistance.

Figure 2:
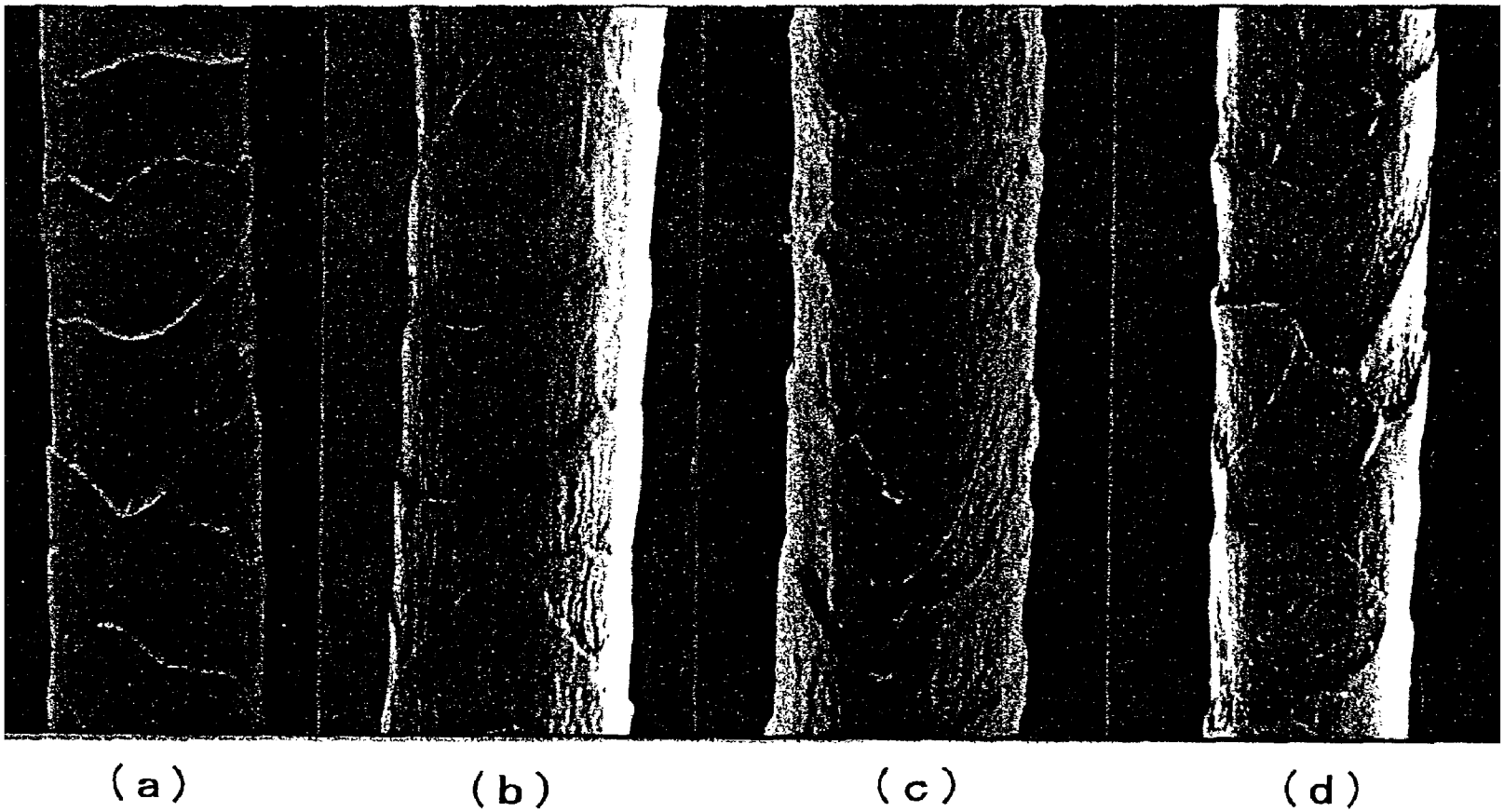
FIG. 2 are photographs of a scanning electronic microscope that show surfaces of untreated wool fiber and various shrink proofing treated wool fiber.

FIG. 2 shows the results of surface observation under an electronic microscope of the animal fiber of the present invention, the shrink proofing animal fiber treated by the conventional method and a natural untreated animal fiber. In FIG. 2, (a) shows an untreated wool fiber, (b) shows a chlorine-treated wool fiber, (c) shows a Chlorine-Hercosett treated wool fiber and (d) shows a wool fiber of the present invention. In comparison with the conventional shrink proofing animal fiber that has a quite smooth surface with hardly any scales being observed, it is confirmed that the animal fiber of the present invention maintains a surface state that is virtually the same as the natural state.

Here, the animal fiber of the present invention includes wool, mohair, alpaca, cashmere, llama, vicuna, camel and angora.

The animal fiber being relatively less performance in pilling property which has the feature described above, can be produced by the method for preparation according to the present invention described below.

Namely, the method for preparation of animal fiber of the present invention comprises that sliver composed of animal fiber is, first, primary-oxidized with an oxidizer having an ability to oxidize a cystine —S—S—bond of the animal fiber, and then, an ozone-oxygen mixed gas is made into ultrafine bubbles of 5 $\mu$ or less in water by using a line mixer and the gas in this condition is allowed to collide against the previously primary-oxidized animal fiber for a given time to cause a gas-phase oxidation reaction in the liquid, resulting in oxidation of the cystine bond of wool into higher order oxidized state. Then, a reduction treatment is performed on the higher order-oxidized animal fiber to cleave the cystine crosslinkage (—S—S—).

And the method of the present invention also has the feature can continuously impart the combined effect of shrink proofing and pilling resistance to the sliver of animal fiber.

In the present invention, the primary-oxidized state of a cystine bond (—S—S—), namely, lower order oxidized state means mono-oxidized state (—SO—S—), di-oxidized state (—$SO_2$—S—) or mixed state thereof. Particularly, it means the state rich in mono-oxidized state. While, the higher order oxidized state means di-oxidized state, tri-oxidized state (—$SO_2$—SO—), tetra-oxidized state (—$SO_2$—$SO_2$—) or mixed state thereof. It is known that though fission of a —S—S— bond by a reducing agent is not easy and requires a longer time in the case of mono-oxidized state, while in di, tri or tetra-oxidized state, fission is effected relatively easily.

The present invention is characteristic in that it effects two-stage oxidation comprising a first step in which animal fiber is subjected to primary oxidation treatment by pad steaming with an oxidizer having an ability to oxidize a cystine —S—S— bond of the animal fiber and a second step in which higher order oxidation is conducted by blowing aqueous treatment liquid containing ozone in the form of ultrafine bubbles of 5$\mu$ or less in the aqueous treatment liquid, for cleaving a cystine bond only in cuticle portions of animal fiber effectively, namely, in a short period of time without unevenness treatment.

Then, a mixed gas of ozone and oxygen produced from an ozone generating apparatus is blown in a liquid circulation pump, further, aqueous ozone treatment liquid containing ozone in the form of ultrafine bubbles of 5$\mu$ or less is prepared through a line mixer, this liquid blown in water on animal fiber primary-oxidized, to ozone-oxidize quickly and preferentially an exocuticle B layer in which a cystine —S—S— bond has been previously oxidized to give higher order oxidized state in the B layer.

Then, a cystine (—S—S—) bond is cleaved by reduction treatment with a reducing agent, for example, a sulfite, to lower the cystine crosslinked density of the exocuticle B layer, as a result, swelling, fluidization and solubilization with water are promoted and a part of protein is allowed to flow out of the fiber.

According to the present invention, the cystine crosslinked density of this exocuticle B layer is reduced by performing pre-oxidation, ozone oxidation and reduction treatment with a sulfite, and as a result of that, about the same level water swelling as that of the endocuticle is obtained and bilateral function of the exocuticle B layer and endocuticle is allowed to disappear. And therefore the edge of scale does not uprise even when animal fiber is immersed in water, and shrinkage does not occur in aqueous washing. Simultaneously, higher degree of shrink proofing is given without deteriorating water repellency since an epicuticle layer and a thioester of eicosanoic acid covering the surface thereof is still kept. And further, since scale is kept in the fiber, withdrawing force of pulling out of a fiber in the fiber assembly is higher and fiber movement in the fiber assembly is suppressed, resulting in correspondingly anti-pilling, as compared with a shrink proofing method in which scale is peeled, de-scaled or a shrink proofing method in which the surface of scale is coated with a resin.

The method for preparation of the animal fiber of the present invention is characteristic in two-stage oxidation comprising a first step in which animal fiber is primary-oxidized and a second step in which the primary-oxidized animal fiber is higher order-oxidized, and in comprising a successive reduction step to cleave the higher order oxidized cystine bond.

The method for preparation of the present invention is described more in detail below.

The first step in the method of the present invention is a pre-treatment step for oxidation of a cystine bond with ozone, and is a stage in which a cystine bond in cuticle tissue of the fiber is primary-oxidized with an oxidizer having an ability to oxidize a —S—S— bond of animal fiber to obtain substantially mono-oxidized state.

As the preferable oxidizer used for primary oxidation, persulfuric acid, peracetic acid, performic acid, per-acids and neutral salts or acidic salts of these per-acids, or potassium permanganate, hydrogen peroxide and the like are exemplified, and these can be used alone or in admixture of two or more. Particularly preferable oxidizer is potassium hydrogen persulfate.

The primary oxidation is conducted through pre-oxidation by a pad (impregnation)-steam (reaction) method, in some occasions, by pad-store (reaction at room temperature). Usually, when potassium hydrogen persulfate is used, an immersion method is adopted, and in this case, a treating reagent permeates into inner portions of fiber and the fiber or whole fiber is oxidized and hydrolyzed to cleave a cystine bond, causing reduction in mechanical properties such as strength, elongation and the like. Nevertheless, shrink proofing effect is not obtained. Further, in a method in which potassium hydrogen persulfate is padded (impregnated) and stored (left at room temperature), reaction with the fiber does not occur and cuticle is not oxidized sufficiently unless the reaction temperature is room temperature or more (substantially, 32° C.). In the present invention, the treatment condition should be set depending on the kind of an oxidizer used and reactivity thereof with the fiber, and in the case of use of potassium hydrogen persulfate, the pad (impregnation)-steam (reaction with heat) method oxidizes a cystine bond only in cuticle portions while preventing oxidation of inner portions of the fiber, thereby, makes easy the subsequent higher order oxidation of cuticle portions with ozone.

At this primary oxidation step, an exocuticle B layer is primarily oxidized at first (first step). Comparing to exocuticle B layer, in the tissue of the epicuticle layer and exocticle A layer being in contact with it, cystine —S—S— crosslinked density is very high, and as a result, the tissue has very high hardness, and manifests chemical resistance and abrasion resistance (this epicuticle part is tissue decomposed lastly even by hydrolysis with 6N-hydrochloric acid. Therefore, epicuticle is treated as a resistant membrane in histology). According to this, exocuticle B layer is more susceptible to oxidation relatively in comparison with epicuticle layer and exocuticle A layer.

Namely, in the first step of the present invention, a wetting agent is put into a bath charged with an oxidizer aqueous solution, the bath temperature is controlled as lower as possible than room temperature, padding (impregnation) is effected so that liquid contact time with animal fiber will be several seconds (about 2 to 3 seconds), the fiber is removed out of the pad bath at a stage wherein the oxidizer aqueous solution does not reach inner portions of the fiber and sufficiently permeates into cuticle, and immediately, squeezed by a mangle so that add-on amount of the oxidizer aqueous solution becomes constant. The fiber thus containing a given amount of the oxidizer aqueous solution is subsequently treated at temperatures around 95° C. in steamer, for promoting a primary oxidation reaction while avoiding drying of the fiber.

Herein, the term "padding" does not mean impregnation of liquid into fiber by merely putting the fiber in a bath but means impregnation so as not to cause a reaction in the immersion bath in view of chemical reactivity of the oxidizer used with animal fiber. It means poor reaction conditions, namely, selection of a wetting agent having high permeability which is not decomposed with an oxidizer in a bath, control of the temperature in a bath as low as possible to suppress a reaction with fiber, and immersion for a short period of time such as several seconds and subsequent immediately squeezing.

The second step in the treatment method of the present invention is a stage in which animal fiber primary-oxidized with an oxidizer is higher order-oxidized with ozone. Usually, in oxidation with ozone, a longer period of time is required, and formation of oxidation state sufficient for cleaving of a cystine bond is difficult. That is, when animal fiber is oxidized with ozone, it is necessary to treat the animal fiber with an ozone gas or ozone dissolved in water of high concentration for 10 to 30 minutes, and under such conditions, continuous treatment was impossible. However, in the present invention, higher order oxidation with ozone in a short period of time with easiness has been made possible by conducting primary oxidation in the first step as a pre-treatment method and rendering ozone into specific state and simultaneously contriving contact method with fiber, and thus continuous treatment step has become possible.

Namely, the present invention is characteristic in that ozone is dispersed in the form of ultrafine bubbles of 5$\mu$ or less at high concentration in water, and further, this aqueous treatment liquid containing ozone in such state is blown to animal fiber, to cause a gas-solid reaction with gas phase of ozone.

Development of an ultrafine bubbles scatter-preventing apparatus which collects ultrafine bubbles of 5$\mu$ or less discharged from a line mixer on the surface of a perforated suction drum and the increase of the number of collision of the ultrafine bubbles against fiber also contributed to completion of the present invention.

In oxidation treatment with ozone in the form of bubbles dispersed in water, the presence of bubbles in water, in general, prevents wetting of fiber assembly with liquid and exerts a reverse influence on wettability of liquid. In the present invention, as means for solving this drawback, a means is adopted in which, first, top sliver of animal fiber is sufficiently fiber-opened by a rotary gill to form a thin web like belt, wound on the surface of a perforated suction drum, and an ozone-oxygen mixed gas is made into ultrafine bubbles of 5$\mu$ or less by using a line mixer, and the liquid is sucked to increase the number of collision against fiber for allowing this ultrafine bubbles to penetrate between fiber and fiber, thereby promoting ozone oxidation.

The present invention will be illustrated in detail according to a process shown in FIG. 3. The animal fiber sliver used is, for example, a top of about 25 g/m, and the nine ends of tops are fiber-opened using a gill to form a belt, and the draft ratio is from about 1.4 to 4-fold, preferably 1.66-fold, though it varies depending on fineness of wool. The feeding speed of a wool top is from 0.2 m/min to 4 m/min, preferably from 0.5 m/min to 2 m/min.

The wool top shaped in the form of a belt is immersed in an aqueous solution containing an oxidizer and wetting agent, and squeezed with a squeezing mangle. Examples of the oxidizer include persulfuric acid, persulfates or acidic persulfates such as potassium hydrogen persulfate, sodium hydrogen persulfate, ammonium persulfate, potassium persulfate and sodium persulfate; potassium permanganate, hydrogen peroxide, performic acid or salts thereof, peracetic acid or salts thereof, and the like. Particularly preferable is potassium hydrogen persulfate [trade name: "Oxone" ($2KHSO_5.KHSO_4.K_2SO_4$, active composition is 42.8% as the proportion of $KHSO_5$); manufactured by E. I. du Pont de Nemours and Company] since it is in the form of a granule, easily dissolved, and an aqueous solution containing the dissolved oxidizer is stable for storage at a temperature of 32° C. or less. As the wetting agent, "Alcopol 650" (manufactured by Chiba Specialty Chemicals K.K.) is preferable since it is stable against an oxidizer. The concentration of the oxidizer is from 10 g/L to 50 g/L, preferably from 20 g/L to 40 g/L when the squeezing ratio is 100% in the case of potassium hydrogen persulfate "Oxone", though it differs depending on the kind of the oxidizer. The concentration of the wetting agent is suitably about 2 g/L in the case of "Alcopol 650". The temperature of the pad liquid is preferably as low as possible so as not to cause a reaction in the liquid. Particularly preferably, it is from 15° C. to 25° C. It is preferable that pH of the liquid is on acidic side. More preferably, pH is 2.0.

After squeezing by a squeezing mangle, an oxidizer is allowed to react with animal fiber sliver, and the treatment conditions vary depending on the kind of the oxidizer. For example, in the case of potassium permanganate, hydrogen peroxide, performic acid or peracetic acid, a method in which an aqueous solution of these compounds is padded, and then, stored at room temperature is recommendable. The store time may advantageously be about 2 to 10 minutes though it varies depending on the kind and concentration of the oxidizer. While, in the case of potassium hydrogen persulfate, potassium persulfate, sodium persulfate or ammonium persulfate, a primary oxidation reaction may advantageously be conducted by steaming treatment at normal pressure, after padding of an aqueous solution of these compounds. Regarding the steaming condition, a temperature of 95° C. and a time from 5 to 15 minutes, preferably of about 10 minutes are sufficient to conducting primary oxidation.

One characteristic of animal fiber is that the cystine (—S—S—) content varies depending on tissues constituting cuticle and cortex. In the present invention, particularly modification of cuticle tissue is conducted for imparting shrink proofing and pilling resistance. Oxidation of a cystine bond —S—S— progresses sequentially as described below, and the —S—S— bond is cleaved after hydrolysis and reducing treatment, and finally, sulfonic acid (—$SO_3H$) is obtained.

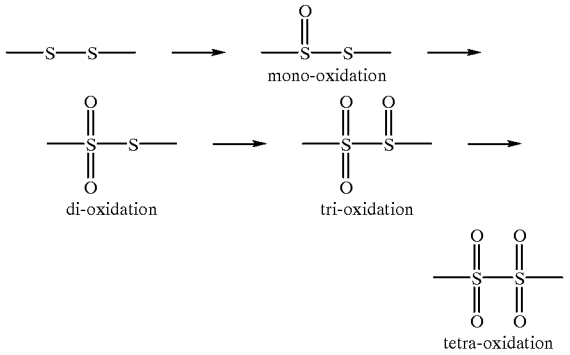

The present invention has a feature that a reaction is effected by a pad-steam method with an oxidizer, for example, potassium hydrogen persulfate, a —S—S— bond is stopped at substantially mono-oxidized state, and is further oxidized to higher order using ozone in the subsequent step.

By adopting this operation, the ozone oxidation reaction rate increases remarkably as compared with oxidation rate when ozone is solely used or potassium hydrogen persulfate is solely used, and continuous treatment of animal fiber sliver becomes possible for the first time, leading to success in industrialization, if a —S—S— bond is primary-oxidized previously, and then, ozone-oxidized, as shown in the following formula:

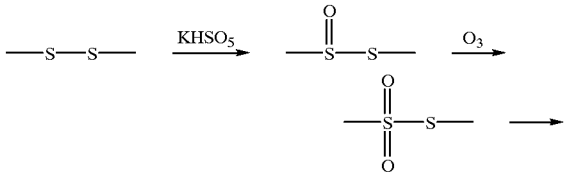

The present invention is characteristic in that an ozone-oxygen mixed gas is allowed to collide against animal fiber sliver by blowing the gas in the form of ultrafine bubbles of 5$\mu$ or less in water, to cause a higher order oxidation through a gas phase reaction. Regarding the ozone generating apparatus, an ozonizer apparatus manifesting a generating capacity of about 250 g/hr (for example, one manufactured by Chlorine Engineering K.K.) can sufficiently effect continuous treatment of animal fiber sliver, and for example, an ozone gas generated by feeding an oxygen gas at a rate of 40 L/min into the ozonizer has a weight concentration of 6.5 wt % and a volume concentration of 0.1 g/L in the mixed gas, and in one example, treatment with an ozone oxygen mixed gas of 4 g/min was an optimum condition though it differs depending on the extent of primary oxidation and other conditions. The feeding amount for imparting shrink proofing and pilling resistance to wool fiber is 6% owf or less, preferably from 1.5% owf to 5% owf based on the weight of wool, though it differs depending on the wool fiber quality.

It is one feature of the present invention that, for reacting an ozone gas efficiently with wool, the ozone gas is formed into bubbles which are as fine as possible in water, the bubbles are allowed to collide against wool, and an oxidation is caused at the collision site. Therefore, also since the water solubility of ozone is extremely low, only cuticle tissue of wool is resultantly oxidized, and cortical tissue which is inner tissue is protected, resulting in further enhancement of the effect to modify the surface of wool. As the method for making an ozone-oxygen mixed gas into ultrafine bubbles of 5$\mu$ or less, a method is preferable in which the mixed gas is introduced into a water flow pump and the mixed gas is allowed to collided against small walls in a cylinder by raising water pressure to give ultrafine bubbles.

It is also a characteristic of the present invention that a special apparatus shown in FIG. 4 was contrived for collecting ultrafine bubbles produced in a line mixer and blowing the bubbles on wool sliver in the form of a belt. Wool sliver (2) in the form of a belt which has been primary-oxidized is sandwiched between stainless mesh belts (1) and (3) and transferred to an ozone treatment bowl (9) equipped with a suction drum (5), where the ultrafine bubbles are blown on wool sliver in the form of a belt through a nozzle (6) from a line mixer (13). And for collecting this ultrafine bubbles at the wool sliver in the form of a belt, an ultrafine bubble-collecting apparatus (4) is mounted on the periphery of a suction drum, and further, liquid containing the ultrafine bubbles is sucked from the center portion (7) of the suction drum to allow the ultrafine bubbles to collide against the wool sliver in the form of a belt. An ozone-oxygen mixed gas produced from an ozonizer (11) is introduced in a water suction pump (12) to cause gas-liquid mixing, and the mixture is fed to the line mixer (13) by raising water pressure to produce ultrafine bubbles which are blown on wool sliver in the form of a belt sandwiched between stainless mesh belts. Further, surface oxidation of wool fiber is completed by using an apparatus sucking through a suction port (7).

Though it is said that ozone is a strong oxidizer second to fluorine, the nature is different at the acidic side and alkaline side. Namely, at the acidic side;

$$O_3+2H^++2e^-=O_2+H_2O\ E_o=2.07\ V$$

while, at the alkaline side;

$$O_3+H_2O+2e^-=O_2+2OH^-\ E_0=1.24\ V$$

and, standard oxidation potential is higher, and further, solubility of ozone in water is higher and the half life is by far longer, at the acidic side.

(half life is 1 second when pH is 10.5 and 105 seconds when pH is 2.0)

The present invention is conducted at the acidic side of pH 1.5 to pH 2.5, preferably, of pH 1.7 to pH 2.0. Ozone has higher solubility, however, lower reactivity, in cold water. The treatment temperature has to be increased for enhancing the reactivity, and the treatment temperature may advantageously be 30° C. to 50° C., and when it is too high, an ozone-oxygen mixed gas shows higher molecular movement, and is scattered out of a treatment bowl. Particularly preferable temperature is 40° C. The reaction time can control the reaction by the feeding speed of wool sliver, namely, the liquid contact time in the ozone treatment bowl. When the feeding speed of sliver is 0.5 m/min, the contact time is 2 minutes, and when 2 m/min, the contact time is 33 seconds, and control of shrink proofing and control of pilling resistance are possible by controlling the reaction time.

The wool sliver ozone-oxidized in the ozone treatment bowl is treated with a reducing agent, and therein, a —S—S— bond is cleaved for the first time as shown in the following formula.

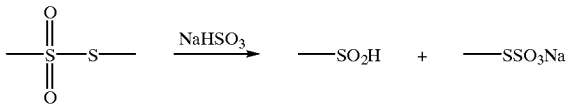

In this method, particularly an exocuticle B layer among cuticle tissues, is attacked, and consequently, the cystine —S—S— crosslinked density decreases and swelling property with water increases to the same water swelling level as that of endocuticle, and consequently, bilateral property of scale of animal fiber disappears, preventing arising of scale edge in water. Therefore, water repellent function which is a characteristic of wool is not lost, and higher degree of shrink proofing and pilling resistance can be imparted while keeping water repellency.

The reducing agent is not particularly restricted, and sulfites are suitable. Among sulfites, sodium sulfite $Na_2SO_3$ (pH 9.7) is more preferable than acidic sodium sulfite $NaHSO_3$ (pH 5.5). Since primary oxidation and ozone oxidation are conducted at the acidic side, reduction treatment at the alkaline side is preferable also from the standpoint of neutralization treatment. The concentration of sodium sulfite is preferably from 10 g/L to 40 g/L, and particularly preferably around 20 g/L. The temperature is preferably from 35° C. to 45° C., and particularly preferably around 40° C.

It is preferable to conduct water rinsing in two steps while effecting over flow, both for removing the remaining sulfite and for removing protein dissolved from the treated wool. The temperature may advantageously be about 40° C.

After water rinsing, a softener and spinning oil agents may be added to the final bowl in view of hand-feeling and spinning property of wool sliver. For example, treatment can also be conducted at 40° C. by adding 1 g/L of Alcamine CA New (manufactured by Chiba Specialty Chemicals K.K.) and 1 g/L of Croslube GCL (manufactured by CTC Textiles Ltd./Miki K.K.).

Drying is conducted preferably at relatively lower temperatures around 80° C. in a suction type drier for avoiding heat yellowing.

Various oxidation methods on animal fiber are compared and considered as follows.

A) In the case of oxidation only by ozone treatment:

1) Ozone has extremely low solubility in water, and it is 39.4 mg/L at 0° C., 13.9 mg/L at 25° C. and 0 mg/L at 60° C., and from the standpoint of continuous treatment of animal fiber sliver, the treatment time becomes too long because of low concentration to be suitable for the continuous treatment. 2) A large amount of an aqueous solution containing dissolved ozone is required. 3) An apparatus generating ozone of high concentration is necessary, increasing equipment investment. 4) when an ozone gas of high concentration is used, a careful caution is required on an exhaust gas and working environment at the spot.

B) In the case of comparison of an immersion method with a pad steam method, regarding oxidation of potassium hydrogen persulfate and the like:

1) An ionic bond (—$NH_3^+$ $^-$OOC—) is one of side-chain bonds being involved in the stabilization of polymer chains in animal fiber, and as the result that chemicals such as potassium hydrogen persulfate is reacted at higher temperature for a longer period of time in an immersion batch method, potassium ion(+), hydrogen ion(+) or persulfate ion(−) is attracted by —$NH_3^+$ or $^-$OOC— and destroys the ionic bond, and further cleaves —S—S— bond. This leads to the lowering of strength, elongation and the like of the fiber and the effect of shrink proofing cannot be obtained.

2) On the other hand, in the method in which animal fiber is oxidized only by pad steaming using potassium hydrogen persulfate, the step of padding operation is used with the intention of immersing under the condition wherein animal fiber and potassium hydrogen persulfate do not react. Therefore, the temperature of an aqueous solution of potassium hydrogen persulfate (stabilization temperature of the aqueous solution, 20° C. or lower) is lowered, immersion in this aqueous solution is effected for a short period of time (2 to 3 seconds) using wetting agent at lower temperature, and immediately, the animal fiber is impregnated with a certain amount of potassium hydrogen persulfate by squeezing with a mangle. And then, this is heated by steaming, and resultantly, a reaction can be conducted only in portions wherein the animal fiber contains the reagent. In this method, the reagent does not invade into inner portions of the fiber but results only in surface layer oxidation and the inner tissue is protected, contributing to shrink proofing and pilling resistance indicating modification in the surface tissue corresponding to the object of the present invention.

C) In the case of ozone treatment after pre-treatment with an oxidizer such as potassium hydrogen persulfate and the like:

1) Once an animal fiber is primary-oxidized, it is easily oxidized quickly with ozone, oxidation on animal fiber is completed in a short period of time, and continuous treatment is made possible. 2) Due to previous primary-oxidation, an oxidation reaction is promoted sufficiently with ozone of lower concentration, and consequently, a continuous treatment of animal fiber sliver becomes possible sufficiently by an apparatus generating ozone of lower concentration. 3) Due to the apparatus generating ozone of lower concentration, working environment does not deteriorate. 4) Owing to the apparatus generating ozone of lower concentration, equipment investment may be small.

As described above, the two-stage oxidation method of the present invention enables unexpected effective oxidation which has not been obtained by oxidation treatment either with an oxidizer or ozone.

In the present invention, as described above, a cystine bond is cleaved uniformly by higher order oxidation of animal fiber and the followed reduction treatment, and resultantly, animal fiber endowed uniformly with shrink proofing and pilling resistance is obtained by continuous steps. In the treated animal fiber obtained like this, the exocuticle B layer is selectively attacked and the integrated structure of epicuticle and exocuticle A layers which is a structurally hard tissue is preserved, and resultantly, eicosanoic acid revealing water repellency is also kept and water repellency of the whole fiber, and fiber strength is also maintained.

While, in a chlorination reaction of animal fiber, a cystine (—S—S—) bond is oxidized and hydrolyzed to give sulfonic acid (—$SO_3H$), and since a peptide chain constituting animal fiber is cleaved in addition to cleavage of a cystine bond, the tensile strength and elongation of fiber are lowered. Also thioester bond tissue formed between eicosanoic acid which is the outermost film of animal fiber and a —SH group in a polypeptide chain is broken, to convert the hydrophobicity into the hydrophilicity. Therefore, water repellent function inherent to wool disappears.

A reaction mechanism by a chlorination reaction is shown below.

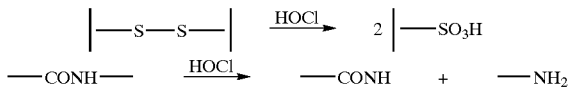

( | and — indicates a polypeptide chain.)

DESCRIPTION OF THE PREFERRED EMBODIMENTS

EXAMPLES

The following examples and comparative examples further illustrate the present invention more specifically, but the examples do not limit the scope of the present invention essentially, and any of suitable modifications in the range applicable to the above-mentioned aspects is contained in the technical range of the invention.

Example 1

Wool sliver was treated continuously according to a process diagram described in FIG. 3. The running speed of the sliver through processes, namely, a pad treatment mangle, ozone treatment bowl, reducing treatment bowl, water rinsing treatment bowl and drying processes was 2 m/min.

[Pad Treatment Process]

9 ends of sliver (25 g/m) made of Merino wool of 20.7$\mu$ from Australia were transferred to a rotary gill, and the wool sliver was fiber-opened into a belt by drafting at a ratio of 1.66. The belt sliver was padded in an aqueous solution having the following composition and squeezed by a mangle.

Pad Aqueous Solution Composition

Potassium hydrogen persulfate $KHSO_5$: concentration is 40 g/L ("Oxone", manufactured by E. I. du Pont de Nemours and Company)

Wetting agent "Alcopol 650": concentration is 2 g/L (manufactured by Chiba Specialty Chemicals K.K.)

Treatment Condition

Contact time: 2 seconds

Temperature: ordinary temperature pH: 2.0

Squeezing rate: 100%

It was squeezed by a mangle, and then, transferred to a steam treatment process.

[Steam Treatment Process]

Wool sliver wetted in the form of a belt was subjected to steam treatment on a conveyor net under the following conditions.

95° C., 10 min

After the steam treatment, the sliver was transferred to an ozone treatment bowl.

[Ozone Treatment Process]

The steam-treated sliver was transferred to a suction type ozone treatment bowl, and ozone-oxidized under the following conditions.

Ozonizer ("OZAT CFS-3", manufactured by Chlorine Engineering K.K.) was used at 250 g/hr, and an oxygen bomb was used as an oxygen source.

Oxygen feeding speed to "Ozonizer OZAT CFS-3"; 40 L/min

Ozone generation weight concentration; 6.5 wt %

Ozone generation volume concentration; 0.1 g/L

Ozone generation amount; 4 g/min

Apparent ozone feeding amount to wool; 1.48% owf 25 g/m×9×1/1.66=135.5 g/m wool 135.5 g/m×2 m/min×contact time 0.55 min (33 sec)=149.05 g wool 4 g/min ($O_3$)×0.55 min=2.2 g $O_3$ 2.2 g/149.05×100=1.48% owf $O_3$ The generated ozone gas was transferred to four line mixers through 4 pumps having a water lifting amount of 80 L/min. The ozone blowing amount in each line mixer was 10 L/min, and the total amount was 40 L/min. The ultrafine bubbles were allowed to collide against on the wool sliver on the suction drum by blowing the bubbles using an ultrafine bubble-scattering-preventing apparatus as shown in FIG. 4, and further, the treatment liquid was sucked from inside of the drum and was circulated to the outer side of the drum for increasing the times thereof, and ozone treatment was conducted under the following conditions.

Ozone bubbles; ultrafine bubbles of about 5$\mu$

Treatment temperature; 40° C.

pH; 1.7 (adjusted with sulfuric acid)

Contact time; 33 seconds

After the ozone treatment, the sliver was transported to a reducing bowl.

[Reducing Treatment Process]

The ozone-treated sliver in the form of a belt was treated under the following conditions in a suction type reducing bowl.

20 g/L; sodium sulfite $Na_2SO_3$ pH; 9.7

Temperature; 40° C.

Contact time; 33 seconds

After the reduction treatment, the sliver was transported to a water rinsing bowl.

[Water Rinsing Treatment Bowl]

The reduction-treated sliver in the form of a belt was treated with hot water of 40° C. for 33 seconds in a suction type water rinsing bowl. After the water rinsing, the sliver was further transported to another water rinsing treatment bowl.

[Water Rinsing Treatment Bowl]

The sliver in the form of a belt was treated with hot water of 40° C. for 33 seconds in a suction type water rinsing treatment bowl. After the water rinsing, the sliver was transported to the final bowl for imparting a spinning oil and softener necessary for the subsequent processes.

[Spinning Oil and Softener Treatment Process]

The water-rinsed sliver in the form of a belt was treated with hot water of 40° C. for 33 seconds in a suction type treatment bowl charged with the following treating agents.

Treating Agent 1 g/L of "Alcamine CA New" (manufactured by Chiba Specialty Chemicals K.K.) and 1 g/L of "Croslube GCL" (manufactured by CTC Textiles Ltd./Miki K.K.).

After the oiling-treatment, the sliver was transported to a drier.

[Drying Process]

Drying was conducted at 80° C. using a suction type hot air drier.

The treated sliver in the form of a belt was gilled and spun into hosiery yarn of 2/48 Nm by twist of Z500×S300, and strength and elongation of the yarn were measured, and knitted into a density of a cover factor C.F. of 0.41, and washed continuously for 1 hour and 3 hours by a Cubex shrinkage testing apparatus. The fabric which had been knitted into a C.F. of 0.41 was subjected to a pilling test for 5 hours by an ICI pilling tester. For further investigating the property of the treated wool fiber, the surface of the wool was observed by an electron microscope, S-3500N manufactured by Hitachi. For measuring the water repellency of the treated wool, the sliver was gilled to be fiber-opened, and each 1 g of the treated sliver and untreated sliver was sampled, 800 mL of distilled water was charged into a 1-L beaker and the sample was floated on the water surface and sedimentation condition was observed. The results thereof are shown in Table 1.

The treated wool sliver was soft and showed white color, and shrink proofing thereof based on WM TM31 method met the standard of area shrinkage percentage under the Wool Mark washability requirement, and also, satisfied 4-th grade level of pilling resistance in the ICI pilling test. The observation of the sedimentation state of 1 g of the sample showed that both of the un-treated wool and the ozone-treated wool did not precipitate even after left for a day and night and were floating on water surface in the beaker, while, the wool treated by a chlorinated resin method (Chlorine Hercosett method) sank beneath water surface in the beaker only after left for 2 to 3 minutes. Though one of properties of animal fiber is that it has naturally water repellent function, in the present invention, an epoch-making experiment result was obtained that shrink proofing can be imparted without losing water repellent function owned by natural wool. In the conventional shrink proofing method, a method in which chlorine-treated wool surface is coated with a Hercosett resin (polyamide epichlorohydrin) is mainly used. On the wool treated thereby, water repellent function tends to be lost and the wool tends to be wetted and resultantly, body temperature is lowered due to high heat conductivity of water, giving chilled feeling to wearer, though shrink proofing is obtained. The surface of the treated wool was observed by using S-3500N low evacuated electron-microscope manufactured by Hitachi which can observe the object in wet condition showed that scale edge of the wool did not uprise, namely, differential frictional effect (D.F.E) was not found, and on the contrary, in the un-treated wool, scale of the wool uprose owing to swollen with water, which is a cause of felting. Therefore, the present invention is a shrink proofing method which does not uprise scale edge of wool in water.

Comparative Example 1

A sliver of 20.7$\mu$ (25 g/m, 9 ends, draft ratio: 1.66-fold) of Merino wool from Australia was continuously treated according to the method in Example 1 using. However, the ozone treatment using an ultrafine bubble-scatter-preventing apparatus was omitted. The results thereof are shown in Table 1. Though the treated wool was bleached, shrink proofing and pilling resistance were approximately at the same level as those of the un-treated wool, and no treatment effect was appreciated.

From comparison of Example 1 with Comparative Example 1, it became apparent that on wool which had been treated previously with potassium hydrogen persulfate as a pre-treatment process, oxidation progresses quickly with a small amount of ozone. Namely, the present invention exemplified in Example 1 is an revolutionary method in which wool fiber can be modified to impart shrink proofing and pilling resistance with a small amount of ozone, and as the result, treatment effect is manifested sufficiently with a small capacity of ozonizer, and consequently, equipment investment decreases and exhaust gas treatment is reduced, and deterioration in working environment is prevented.

Comparative Example 2

A sliver of 20.7$\mu$ (25 g/m, 9 ends, draft ratio: 1.66-fold) of Merino wool from Australia was continuously treated according to the method in Example 1 using. However, the pre-treatment using potassium hydrogen persulfate was omitted. The results thereof are shown in Table 1. Though the treated wool was somewhat bleached, shrink proofing and pilling resistance were completely at the same level as those of the un-treated wool.

TABLE 1

| | 2/48 Nm, Z500 × S300 Hosiery yarn | | Knitted fabric having CF of 0.41 Felt shrinkage test | | Pilling test (ICI) | Water repellency (sink/float method), visual observation | Whiteness | Hand-feeling |
|---|---|---|---|---|---|---|---|---|
| | Strength (g) | Elongation (%) | 1 hour (area %) | 3 hours (area %) | 5 hours, grade | | | |
| Example 1 | 266.8 | 11.9 | 0.49 | 0.99 | 4 | The same as natural wool | White | Soft |
| Comparative Example 1 | 260.7 | 11.4 | −59.73 | −73.15 | 1 | The same as natural wool | White | Soft |
| Comparative Example 2 | 314.5 | 16.3 | −63.11 | −75.30 | 1–2 | The same as natural wool | White | Soft |
| Example 2 | 258.9 | 9.0 | 3.71 | 1.52 | 5 | Somewhat reduced | White | Soft |
| Un-treated | 296.5 | 13.2 | −70.00 | −75.00 | 1 | Water repellency is recognized | Cream color | Soft |

Notice: minus (−) in table indicates shrinkage

Example 2

Sliver of 20.7 $\mu$ of Merino wool from Australia was treated according to the method in Example 1. However, the transferring speed of the wool sliver was 0.55 m/min and the contact time of the treatment liquid for the wool sliver in the ozone treatment bowl and other treatment bowl was 2 minutes. The apparent ozone feeding amount to wool was 5.37% owf.

25 g/m×9×1/1.66=135.5 g/m wool 135.5 g/m×0.55 m/min×contact time 2 min=149.05 g wool 4 g/min ($O_3$)×2 min=8 g ($O_3$)

8 g/149.05 g×100=5.37% owf $O_3$

The treated wool sliver was gilled and spun into hosiery yarn of 2/48 Nm by twist of Z500×S300, and knitted into a density of a cover factor C.F. of 0.41, and continuous washing tests for 1 hour and 3 hours by a Cubex shrinkage testing apparatus, and further, a pilling test for 5 hours using an ICI pilling tester were conducted, and strength and elongation of the knitted yarn were measured. For observing modification state of the surface of the wool, 1 g of the treated sliver was fiber-opened by a gill, 800 mL of distilled water was charged into a 1-L beaker and the sliver was floated on the water surface and sedimentation condition was observed.

The results of the tests are shown in Table 1. The treated wool sliver was soft and also reveals whiteness, and further, by increasing the ozone feeding amount by about 3.6-fold of that in Example 1, shrink proofing was much superior to the Wool Mark washability requirement, and such high degree of pilling resistance that the result of an ICI pilling test was 5-th grade even after 5 hours was obtained. Since the reaction amount of ozone was increased, strength and elongation of the knitted yarn somewhat decreased, and regarding water repellent resistance, in the case of chlorine-treated wool, completion precipitation to beneath water surface was observed, and this treated wool revealed slight reduction as compared with natural non-treated wool.

Example 3

The same processes as Example 1 were carried out except that the contact time of the ozone treatment was set to one minute so that a shrink proofing treatment was carried out on Merino wool of 20.7 micron from Australia. The resulting shrink proofing wool fiber was evaluated on its properties, and the results are listed in Table 2 in comparison with untreated wool, chlorine treated wood and Chlorine-Hercosett treated wool. Moreover, electronic microscopic photographs of the fiber surface are shown in FIG. 1, and the results of water repellency tests using a water droplet dripping method onto a knitting fabric are shown in FIG. 5.

With respect to the evaluation of the properties in Table 2, as described earlier, the felting shrinkage rate was measured in conformity with WM TM31 method and the fabric knitted into a cover-factor C.F. 0.41 with one line being taken from 14 gages was used as a sample. The pilling resistance was measured by a pilling test method in accordance with JIS L 1076.6. 1A by using the fabric knitted by IP18G. Moreover, the coefficient of friction $\mu_a$ in the tip to root direction to the scale direction of the single fiber and the coefficient of friction $\mu_w$ in the root to tip direction to a fiber direction were measured in conformity with JIS L 1015 under the conditions of a hanging line load of 200 mg and a cylinder peripheral velocity of 90 cm/min.

Moreover, with respect to FT-IR, the fiber itself was measured by a reflection method (ATR method). The figures are given as relative absorbances of the absorption bands corresponding to the —$SO_3H$ group and the —S—$SO_3Na$ group in the case when the absorbance of the absorption band corresponding to amide I is set to 1.

Table 2 shows the results of evaluation on the dying property by the use of a basic dye that provides a measure for the existence of sulfonic acid groups.

Moreover, in order to confirm the existence of the epicuticle layer, evaluation was carried out by using the Allw örden reaction. The results thereof are shown in FIG. 6.

As clearly indicated by these data, differently from the conventional shrink proofing fibers, the shrink proofing wool fiber of the present invention allows scales to remain in the same degree as the natural untreated wool (FIG. 1), thereby maintaining a better water repellence property (FIG. 5).

Moreover, the pilling resistance is remarkably improved as compared with those conventional treated fibers that have only little improvements.

Furthermore, the felting shrinkage rate is greatly improved, and the difference in the coefficients of friction (static friction and dynamic friction) of the single fiber, which provides one measure for the felting shrinkage rate, that is, the difference "$\mu_a-\mu_w$" between the coefficients of friction in the tip to root direction and in the root to tip direction with respect to a fiber direction, becomes smaller, thereby making the anisotropy smaller.

The FT-IR data shows that, in comparison with the other fibers, the shrink proofing improved fiber of the present invention has much more sulfonic acid groups (—$SO_3H$) and Bunte salts (—S—$SO_3Na$), which indicate a higher order oxidized state, generated on the surface thereof, thereby indicating that the surface oxidation has been carried out efficiently.

As shown in FIG. 6, in the animal fiber of the present invention, the generation of bubbles was observed through the Allwörden reaction in the same manner as the untreated animal fiber, thereby indicating that the epicuticle layer sufficiently existed. In contrast, in the case of "chlorine-treated wool" and "Chlorine-Hercosett-treated wool", no bubbles were generated, indicating that the epicuticle layer had been broken.

The "chlorine-treated wool" and the "Chlorine-Hercosett-treated wool", evaluated for comparative purposes, were prepared as described below:

Preparation of Chlorine Treated Wool:

Wool sliver was successively dipped in a chlorine treatment bath, and this was squeezed by a squeezing roll, and then dipped in an anti-chlorine treatment bath, and this was squeezed by a squeezing roll, washed with water, and then dried.

Chlorine treatment: Chlorine gas was blown into water so as to set an amount of active chlorine in the range of 1.8% to 2.0% owf with respect to the weight of wool, and the treatment was performed at pH 2.0 in cold water for several tens of seconds.

Anti-chlorine treatment: Sodium sulfite (40 g/L) was adjusted to pH 0.9 by using sodium bicarbonate, and the treatment was performed at 30° C. for several tens of seconds.

Washing treatment: The resulting fibers were dipped in a washing bath at 40° C. for several tens of seconds, and then squeezed by a squeezing roll.

Drying treatment: The resulting fibers were dried by using a suction-type drier.

Preparation of Chlorine-Hercosett-Treated Wool:

After the above-mentioned chlorine treatment, anti-chlorine treatment and water washing treatment, the resulting wool sliver was dipped in a processing bath in which Hercosett resin WT-570 (made by Dick Hercules Co., Ltd.) had been dissolved, and this was squeezed, and then dipped in a treatment bath containing a softening agent and a spinning oil, squeezed, and then dried.

Hercosett resin treatment: The resin bath concentration was set to 2% owf with respect to the weight of wool, the bath pH being adjusted to pH 7.5 with sodium bicarbonate, and the treatment was performed at 35° C. for several tens of seconds, and the resulting wool was squeezed by a squeezing roll.

Softening treatment: The bath temperature was adjusted so that Alcamine CA-New (made by Chiba Specialty Chemicals K.K.) serving as a softening agent was set to 0.5% owf with respect to the weight of wool and Croslube GCL (made by CTC Textiles Ltd./Miki K.K.) serving as a spinning oil was set to 1.35% owf with respect to the weight of wool, and the treatment was performed at 30° C. for several tens of seconds, and the resulting wool was squeezed by a squeezing roll.

Drying treatment: The resulting wool was dried by a suction-type drier.

TABLE 2

| | | Untreated | Chlorine treated | Chlorine-Hercosett treated | Example 3 |
|---|---|---|---|---|---|
| Felting shrinkage rate (% area) | Cubex 1 hr | −58.2 | 4.0 | −0.7 | −0.4 |
| | Cubex 3 hr | −72.1 | −6.2 | −3.5 | −3.9 |
| Coefficient of static friction of single fiber | $\mu_a$ | 0.335 | 0.270 | 0.232 | 0.351 |
| | $\mu_w$ | 0.132 | 0.216 | 0.174 | 0.235 |
| | $\mu_a-\mu_w$ | 0.203 | 0.054 | 0.058 | 0.116 |
| Coefficient of dynamic friction of single fiber | $\mu_a$ | 0.313 | 0.249 | 0.240 | 0.320 |
| | $\mu_w$ | 0.189 | 0.211 | 0.199 | 0.273 |
| | $\mu_a-\mu_w$ | 0.124 | 0.038 | 0.044 | 0.047 |
| Scales (Observation under electronic microscope) | | ○ | X | X | ○ |
| Pilling (Class) | | 1–2 | 2 | 2 | 3–4 |
| Dyeing property (Astrazon Blue) | | Slightly pale color | Highly dark color | Intermedi-ate dark color | Highly dark color |
| FT-IR | —SO—S— | 0.07 | 0.05 | 0.06 | 0.06 |
| | —$SO_2$—S— | 0.02 | 0.02 | 0.02 | 0.02 |
| | —$SO_3H$ | 0.06 | 0.12 | 0.14 | 0.16 |
| | —S—$SO_3Na$ | 0.03 | 0.12 | 0.08 | 0.28 |
| Water repellency (Water droplet dipping method) | | ○ | X | X | ○ |

Note: In the Table, minus (−) indicates shrinkage.

With respect to the evaluation items of Table 2, the evaluation methods of those items other than the already mentioned felting shrinkage rate, single fiber coefficient of friction, pilling resistance, FT-IR measurement and water repellence property, will be described below.

[Confirmation of Existence of Epicuticle Layer]

Allwörden reaction: Several wool single fibers were put on a glass plate, and several droplets of saturated bromine water were dropped thereon, and immediately after this, the state of the surface of each fiber was observed under an optical microscope. When any epicuticle layer existed, bubbles would be generated on the surface of the fiber. Therefore, the existence of any epicuticle layer was confirmed depending on the generation of bubbles.

[Existence of Scales]

An electronic microscope was used to observe scales.

[Dyeing Property by Basic Dye]

In a water solution containing 1 g/L of Astrazon Blue 3RL (made by Bayer Corp.) and 1 ml/L of a nonionic wetting agent were dipped wool fibers in a bath ratio of 1:100, at 20° C. for 5 minutes, and this was then washed with water, and observed to find their dyed state.

The darkish the dyed state, the more the sulfonates formed through oxidation.

The present invention makes it possible to provide an animal fiber having superior shrink proofing and pilling resistance without impairing a water repellent property that animal fibers originally possess as a superior feature, as well as without causing degradation in the fiber mechanical properties. Moreover, the present invention also provides a manufacturing method of the animal fiber having the above-mentioned features, without using a toxic chemical such as chlorine, etc. In addition, the method of the present invention makes it possible to carry out a continuous processes, and consequently to provide a useful method from the industrial point of view.

What is claimed is:

1. A modified animal fiber having a surface morphology that is substantially the same as that possessed by the fiber in its un-modified form, the modified animal fiber comprises chemically modified epidermal tissue epidermal tissue that exhibits an absorption band for —$SO_3H$ group having a relative absorbance of not less than 0.1 and an absorption band for —S—$SO_3Na$ group (Bunte salts) having a relative absorbance of not less than 0.08, when measured using reflection FT-IR having an absorption band corresponding to amide I set to 1, the epidermal tissue having epicuticle layers which afford a water repellency, confirmed by an Allwörden reaction, that is substantially the same as that possessed by the fiber in its un-modified form, wherein the modified animal fiber exhibits shrink proofing of an area shrinkage rate of not more than 8% in a three-hour aqueous washing when measured as a felting shrinkage rate in conformity with Woolmark Test Method 31 and pilling resistance of not lower than third class in JIS L-1076.6.1A method;

said modified animal fiber produced by a process which comprises:

a) a first step in which a cystine —S—S— bond in cuticle layers on surface of the fiber is subjected to primary oxidation with an oxidizer having an ability to oxidize the —S—S— bond in the cuticle layers by a pad steam treatment of the modified animal fiber with an aqueous solution of oxidizing agent under acidic conditions to contain a state rich in mono-oxidized state, b) a second step in which the primary-oxidized —S—S— bond is subjected to an oxidation treatment with ozone being conducted by direct blowing 5 $\mu$m or less ultrafine bubbles of an ozone/oxygen-mixed gas to the primary-oxidized animal fibers in an aqueous, acidic treating liquid at a pH of 1.5 to 2.5 and at a temperature of 30 to 50°C., into higher order oxidized state containing di, tri or tetra-oxidized state or a mixture thereof, and c) a third step in which said —S—S— bond in higher oxidized state is subjected to reductive cleavage.

2. The modified animal fiber according to claim 1, wherein, as a measure of shrink proofing, the value represented by a difference ($\mu_a$–$\mu_w$) between the coefficient of friction in the tip to root direction ($\mu_a$) and the coefficient of friction in the root to tip direction ($\mu_w$) with respect to a fiber direction, measured in accordance with JIS L-1015 method, is lower by 30% or more in comparison with the difference ($\mu_a$–$\mu_w$) of unmodified animal fiber in coefficient of static friction or in coefficient of dynamic friction, the value of $\mu_a$ being approximately the same as a value in the case of the unmodified animal fiber, and the value of $\mu_w$ being higher by 30% or more in comparison with a value in the case of the unmodified animal fiber.

3. The modified animal fiber according to claim 1, wherein the animal fiber is one selected from the group consisting of wool, mohair, alpaca, cashmere, llama, vicuna, camel and angora.

4. The modified animal fiber of claim 1, wherein the oxidizer is one or a mixture of two or more selected from the group consisting of persulfuric acid, peracetic acid, performic acid, neutral salts and acidic salts of these per-acids, potassium permanganate and hydrogen peroxide.

5. The modified animal fiber of claim 1, wherein the modified animal fiber is used as cloth or sliver mainly composed of modified animal fibers.

6. The animal fiber of claim 1, wherein the reductive cleavage is carried out using sulfites.

7. The animal fiber of claim 1, wherein the reductive cleavage is carried out using sodium sulfites or acidic sodium sulfite.

8. The animal fiber of claim 1, wherein the reductive cleavage is carried out using sodium sulfites.

* * * * *